US011933126B2

(12) United States Patent
Atkins et al.

(10) Patent No.: US 11,933,126 B2
(45) Date of Patent: Mar. 19, 2024

(54) DRILL STRINGS AND RELATED BALL DROPPING TOOLS

(71) Applicant: Schlumberger Technology Corporation, Sugar Land, TX (US)

(72) Inventors: James Edward Atkins, Aberdeen (GB); James Andrew Blair Henderson, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/905,655

(22) PCT Filed: Mar. 8, 2021

(86) PCT No.: PCT/US2021/021287
§ 371 (c)(1),
(2) Date: Sep. 6, 2022

(87) PCT Pub. No.: WO2021/178944
PCT Pub. Date: Sep. 10, 2021

(65) Prior Publication Data

US 2023/0340848 A1 Oct. 26, 2023

(30) Foreign Application Priority Data

Mar. 6, 2020 (GB) ..... 2003287

(51) Int. Cl.
*E21B 23/06* (2006.01)
*E21B 23/00* (2006.01)
(Continued)

(52) U.S. Cl.
CPC ..... *E21B 23/06* (2013.01); *E21B 23/00* (2013.01); *E21B 33/068* (2013.01); *E21B 34/142* (2020.05)

(58) Field of Classification Search
CPC ..... E21B 34/14; E21B 34/142
See application file for complete search history.

(56) References Cited

U.S. PATENT DOCUMENTS 4,577,614 A 3/1986 Schoeffler
6,715,541 B2 4/2004 Pedersen et al.
(Continued)

FOREIGN PATENT DOCUMENTS

WO 2007016313 A2 2/2007
WO 2015038096 A1 3/2015
WO 2016190850 A1 12/2016

OTHER PUBLICATIONS

International Search Report and Written Opinion in International Patent Application No. PCT/US2021/021287, dated Jun. 18, 2021, 8 pages.
(Continued)

*Primary Examiner* — Robert E Fuller
(74) *Attorney, Agent, or Firm* — Bridget M. Laffey

(57) ABSTRACT

A ball dropping tool includes an outer and inner body, side bore, ball and an actuator. The outer body has an axial bore extending between a first and second end of the outer body and forming a flow path. The inner body forms a bypass passage extending between a first and second end of the inner body. The side bore is defined by the inner body and is disposed at an angle relative to the axial bore of the outer body. The bypass passage is disposed in a portion of the flow path and is in communication with the side bore. The ball is disposed within the side bore. The actuator, disposed within the outer body, is movable between a retaining position wherein the ball is retained within the side bore and a release position wherein the ball is released from the side bore and into the bypass passage.

16 Claims, 4 Drawing Sheets

(51) Int. Cl.
*E21B 33/068* (2006.01)
*E21B 34/14* (2006.01)

(56) References Cited

U.S. PATENT DOCUMENTS

| | | | | |
|---|---|---|---|---|
| 7,100,700 | B2 | 9/2006 | Davis et al. | |
| 7,530,400 | B2 | 5/2009 | Telfer | |
| 7,624,810 | B2 * | 12/2009 | Fould | E21B 47/12 175/324 |
| 9,970,264 | B2 * | 5/2018 | Tulloch | E21B 10/00 |
| 2003/0155115 | A1 | 8/2003 | Pedersen et al. | |
| 2008/0223586 | A1 | 9/2008 | Barnett | |
| 2014/0238697 | A1 | 8/2014 | Slup et al. | |
| 2015/0000901 | A1 | 1/2015 | Guidry et al. | |
| 2015/0068771 | A1 | 3/2015 | Richards et al. | |
| 2016/0290087 | A1 | 10/2016 | Cherewyk et al. | |

OTHER PUBLICATIONS

Combined Search and Examination Report under Sections 17 and 18(3) in GB Patent Application No. GB2003287.6, dated Dec. 2, 2020, 13 pages.

* cited by examiner

DRILL STRINGS AND RELATED BALL DROPPING TOOLS

CROSS-REFERENCE TO RELATED APPLICATIONS

This application claims the benefit of, and priority to, UK Patent Application No. 2003287.6, filed Mar. 6, 2020 and titled "Drill Strings and Related Ball Dropping Tools", which application is expressly incorporated herein by this reference in its entirety.

BACKGROUND

Drill strings for use with hydrocarbon operations may include ball-operated tools. The ball-operated tools may be adapted to actuate in response to receiving a ball from the surface.

BRIEF DESCRIPTION OF THE DRAWINGS

The present disclosure is best understood from the following detailed description when read with the accompanying figures. It is emphasized that, in accordance with the standard practice in the industry, the drawings are drawn to scale for an example embodiment, but are not drawn to scale for all embodiments of the present disclosure. In fact, the dimensions of the various features may be increased or reduced for operation in a variety of different applications or in connection with a variety of different tools or operations.

DETAILED DESCRIPTION

Illustrative examples of the subject matter claimed below will now be disclosed. The examples disclosed herein relate to ball dropping tools that may be included with a drill string. The ball dropping tools may house releasable balls. In other embodiments, although the term 'balls' is used, a dart or similar other activation component may be used. The balls (including darts and similar components) are receivable by downhole, ball-operated tools. When the ball-operated tools receive one or more balls, these ball-operated tools can perform different functions. Because the ball dropping tools are positioned downhole, an amount of time for a ball to be received by the corresponding ball-operated tool is significantly decreased as compared to known methods of dropping a ball from the surface. Moreover, the example ball dropping tools allow balls to be released below obstructions/restrictions in bore diameters in the hole such that balls can be received by ball-operated tools that may otherwise not be accessible. Put another way, if the balls were dropped from the surface and not below the obstruction/restriction, the ball would be unable to pass the obstruction/restriction.

Figure 1:
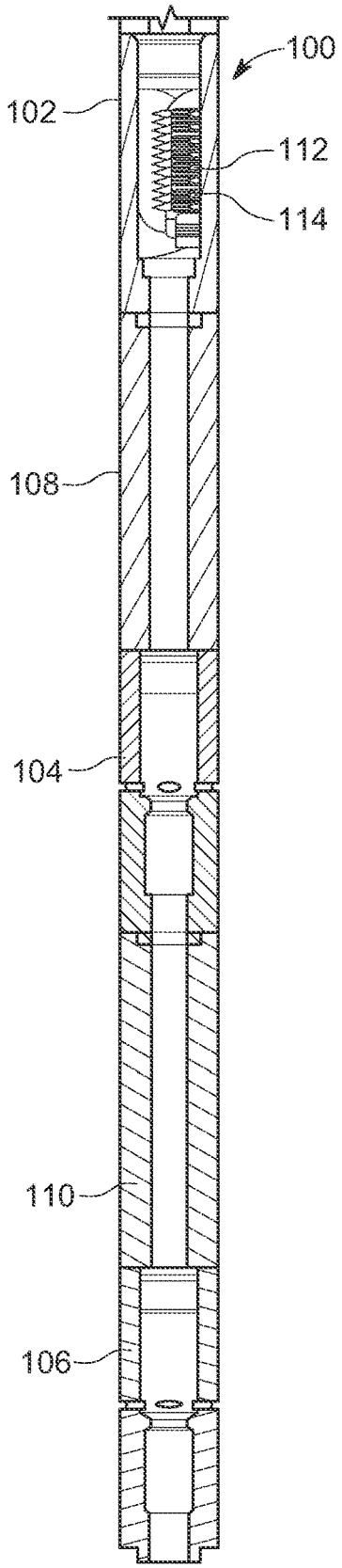
FIG. 1 is a cross-sectional view of a drill string in accordance with a first example of the present disclosure.

Referring now to the drawings, FIG. 1 is a cross-sectional view of a drill string 100 in accordance with a first example of the present disclosure. In the example shown, the drill string 100 includes a ball dropping tool 102 (shown more clearly in FIGS. 2, 3, and 4), a ball-operated tool 104, and a second ball-operated tool 106. The ball-operated tool 104 is positioned downhole of the ball dropping tool 102. The second ball-operated tool 106 is also positioned downhole of the ball dropping tool 102. While two ball-operated tools 104, 106 are shown, any other number of ball-operated tools may be included instead. For example, one ball-operated tool may be included, three ball-operated tools may be included, or four or more ball-operated tools may be included.

The tools 102, 104, 106 are coupled together by a plurality of segments 108, 110. The segments 108, 110 may include one or more sections of a pipe, collar, downhole tool, bottomhole assembly, or the like.

Figure 2:
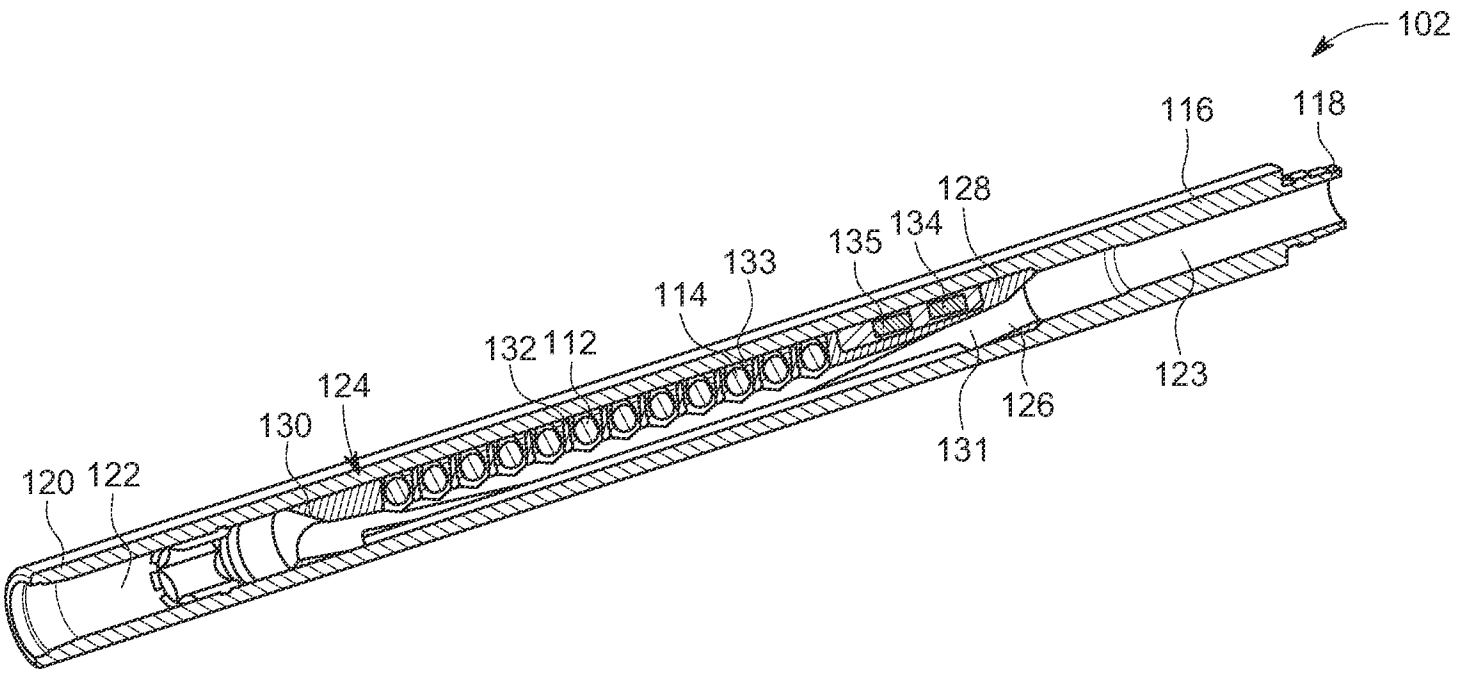
FIG. 2 is a cross-sectional, isometric view of a ball dropping tool of the drill string of FIG. 1.
Figure 3:
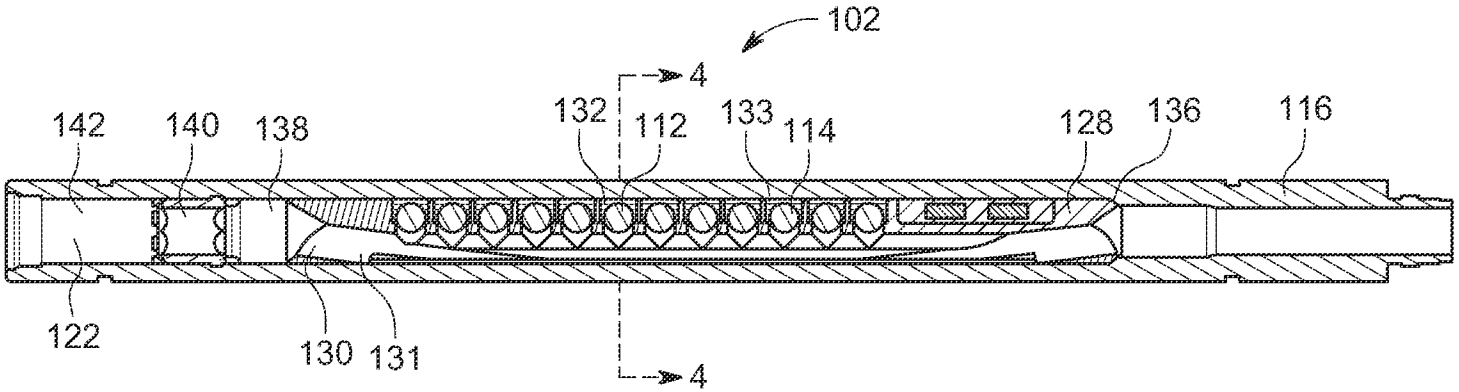
FIG. 3 is a longitudinal cross-sectional view of the ball dropping tool of the drill string of FIG. 1.

In the example shown, the ball dropping tool 102 includes a plurality of balls 112, 114, which are more clearly shown in FIGS. 2 and 3. The balls 112, 114 are optionally different sizes. When different size balls are included, a smaller sized ball 112 may pass through the ball-operated tool 104 and seat within the second ball-operated tool 106, and a larger sized ball 114 may seat within the ball-operated tool 104. In another example, the balls are the same size.

In operation and as discussed in more detail below, the ball dropping tool 102 is adapted to release one or more of the balls 112, 114. The released ball 112, 114 is adapted to be received within a corresponding one of the ball-operated tools 104, 106 causing them to actuate. Actuating the ball-operated tools 104, 106 may include moving sleeves of the tools 104, 106 that cause ports to open into an annulus of a borehole in which the drill string 100 is positioned.

FIG. 2 is a cross-sectional, isometric view of the ball dropping tool 102 of the drill string 100 of FIG. 1. In the example shown, the ball dropping tool 102 includes an outer body 116 including a first end 118 and a second end 120. The outer body 116 includes an axial bore 122. The axial bore 122 extends between the first end 118 and the second end 120 of the outer body 116 and forms a flow path 123.

The ball dropping tool 102 includes an internal assembly 124. The internal assembly 124 is positioned within the axial bore 122. In the example shown, the internal assembly 124 includes an inner body 126 having a first end 128 and a second end 130. The inner body 126 also forms a bypass passage 131 that extends between the first end 128 and the second end 130.

A plurality of side bores (two indicated as side bores 132, 133) are defined by the inner body 126. The side bores 132, 133 may be referred to as transverse bores. The side bores 132, 133 are each at an angle relative to the axial bore 122 of the outer body 116. The angle may be substantially perpendicular. Other angles may prove suitable. For instance, other angles may be within a range that includes a lower limit, upper limit, or lower and upper limits that include 45°, 50°, 60°, 70°, 80°, 90°, 100°, 110°, 120°, 130°, 135°, or values therebetween relative to the axial bore 122 of the outer body 116. In some examples, angles less than 45° or greater than 135° may be suitable. In this example, the side bore 132 is longitudinally spaced from the side bore 133. The bypass passage 131 is in a portion of the flow path 123 of the outer body 116 and is in communication with the side bores 132, 133.

The balls 112, 114 are within the side bores 132, 133. The side bores 132, 133 may have similar or different sizes or cross-sectional shapes. A diameter of the side bores 132, 133 may correspond to a diameter of the associated ball 112, 114. For instance, the diameter of the side bores 132, 133 may be about the same as the diameter of the associated ball 112, 114, or even larger. For instance, the diameter of the side bores 132, 133 are optionally within 0% to 25% larger than the diameter of the associated ball 112, 114. In other embodiments, however, such as where a ball 112, 114 is deformable, the diameter of the side bore 132, 133 could be smaller than the diameter of the associated ball 112, 114, or the side bore 132, 133 may have a diameter that is more than 25% larger than the diameter of the associated ball 112, 114.

The side bores 132, 133 and the bypass passage 131 intersect, thereby allowing the balls 112, 114 to move from the side bores 132, 133 into the bypass passage 131. The bypass passage 131 may be used to flow drilling fluid through the drill string 100. The bypass passage 131 may also allow other objects to pass down the drill string 100.

In the example shown, the internal assembly 124 includes a communication unit 134. The internal assembly 124 also includes a power source 135. The power source 135 is coupled to the communication unit 134. In some examples, the communication unit 134 is responsive to an input to cause the ball dropping tool 102 to perform functions as disclosed herein. The input may be a wireless communication or a wired communication. The wireless communication may be a mud-pulse communication. Other communication methods may prove suitable. Non-limiting examples of other communications can include pressure pulses, rotational or vibrational communications (e.g., patterns of changes to rotational speed), electromagnetic communication, flowing of active or passive RFID tags through the internal assembly 124, or the like.

The communication unit 134 may include a processor, a memory, computer-readable storage media (e.g., read-only memory), an input/output device, other components, or combinations of the foregoing. The power source 135 may be a battery or a turbine. Other power sources may also be suitable. In response to a signal, the communication unit 134 may operate actuators (e.g., actuators 146, 148 described with reference to FIG. 4) in a suitable manner. For instance, the processor, computer-readable media, and power source of the communication unit 134 may use a servo motor, magnetic actuator, or the like, to expand or retract actuators 146, 148. In other embodiments, a mechanical indexing mechanism may be used instead of, or in combination with, communication unit 134. For instance, fluctuations in fluid pressure may activate an indexing mechanism to allow flow to expand and retract actuators 146, 148.

FIG. 3 is a longitudinal cross-sectional view of the ball dropping tool 102 of the drill string 100 of FIG. 1. In the example shown, the outer body 116 includes an internal step 136. The first end 128 of the internal assembly 124 abuts the internal step 136.

A spacer 138 and a collar 140 are also shown within the axial bore 122. The spacer 138 is positioned between the collar 140 and the internal assembly 124. The collar 140 may be coupled to an internal surface 142 of the outer body 116 that defines the axial bore 122. The coupling between the collar 140 and the outer body 116 may urge the internal assembly 124, via the spacer 138, into engagement with the internal step 136, or otherwise secure the internal assembly 124 within the outer body 116.

The collar 140 may be coupled within the outer body 116 using a suitable connection. For example, a threaded or snap-fit connection may be used. In an illustrative snap-fit connection, the collar 140 may include fingers that are outwardly biased and adapted to be received within a corresponding internal groove or other structure of the outer body 116. The collar 140 may, however, be coupled within the outer body 116 in different ways. For example, the collar 140 may threadedly engage the internal surface 142 of the outer body 116 and/or fasteners may be used to couple the collar 140 and the outer body 116. The fasteners may include screws.

Figure 4:
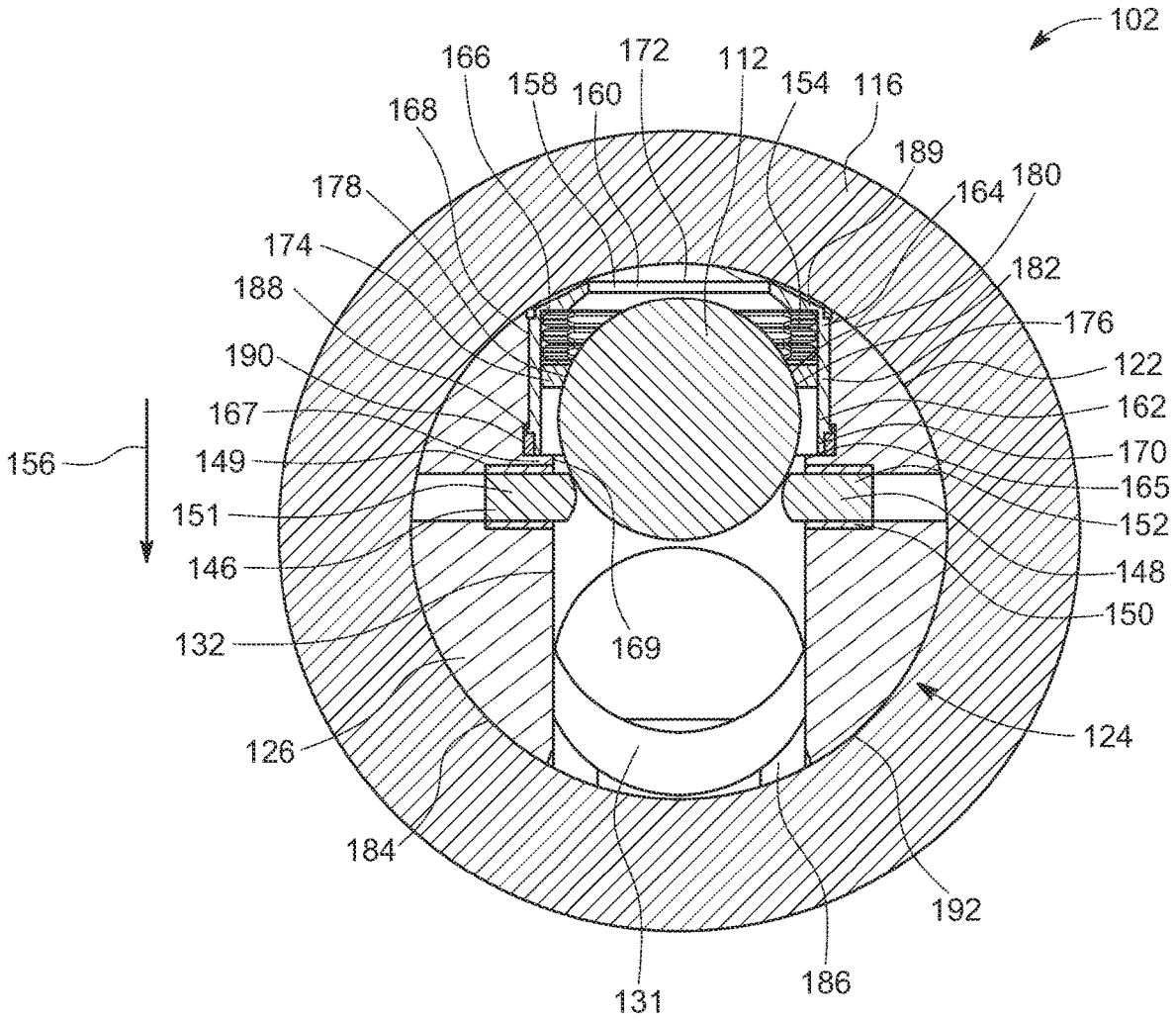
FIG. 4 is a lateral cross-sectional view of the ball dropping tool of FIG. 1 taken along line 4-4 of FIG. 3.

FIG. 4 is a lateral cross-sectional view of the ball dropping tool 102 of FIG. 1 taken along line 4-4 of FIG. 3. The ball 112 is shown within the side bore 132. An actuator 146 is within the outer body 116. In the example shown, the actuator 146 is positioned within the inner body 126; however, the actuator 146 may otherwise be coupled to the inner body 126.

The actuator 146 is movable between a retaining position that retains the position of the ball 112 within the side bore 132 and a release position that allows the ball 112 to be released from the side bore 132 and into the bypass passage 131. In the illustrated embodiment, the retaining position is radially inward relative to the release position of the actuator 146. When the ball 112 is released by the actuator 146, the ball 112 is free to move along the bypass passage 131 and the axial bore 122.

A second actuator 148 is also positioned within the inner body 126. The second actuator 148 opposes the actuator 146. The inner body 126 defines a pair of opposing actuator bores 149, 150. The actuator bores 149, 150 are in communication with/intersect the side bore 132 and the actuators 146, 148 are within a corresponding one of the actuator bores 149, 150. While two actuators 146, 148 are shown, another number of actuators may be included. For example, one actuator may be included to control the position of the ball 112.

Each of the actuators 146, 148 includes an actuator arm 151, 152. The actuator arms 151, 152 may be rods. In another example, the actuator arms 151, 152 may be a pair of plates. If the actuator arms 151, 152 are plates, the inner body 126 defining the side bore 132 may define a groove or grooves that receives sides of the plate. If one plate is used instead of two, the ball dropping tool 102 may include one actuator instead of the two actuators shown. Using the plate may deter debris and/or drilling fluid from entering a portion of the side bore 132 where the ball 112 is retained. The actuators 146, 148 may be solenoids. However, other types of actuators may be used.

The actuators 146, 148 are movable between an extended position and a retracted position. In the example shown, the actuators 146, 148 can be actuated to extend the actuator arm 151 into the side bore 132 and retain the position of the ball 112 within the side bore 132, thereby blocking the passage of the ball 112 into the bypass passage 131. The actuators 146, 148 can be actuated to retract the actuator arms 151, 152 relative to the side bore 132 to allow the ball 112 to move from the side bore 132 and into the bypass passage 131. Movement of the actuators 146, 148 may be translational or rotational (e.g., pivotable) to cause retraction and extension of the actuators 146, 148 and ultimately release of the ball 112.

A spring 154 is within the side bore 132. The spring 154 is an example of a biasing member and in this embodiment is positioned between the outer body 116 and the ball 112. The spring 154 is adapted to urge the ball 112 out of the side bore 132 in a direction generally indicated by arrow 156. The spring 154 may at least partially surround the ball 112 when the ball 112 is retained within the side bore 132.

The springs 154 are shown as being wave springs or including one or more Belleville washers; however, other types of biasing elements may be used. For example, the spring 154 may be a coil spring. In another example, the spring 154 may be eliminated. If the spring 154 is eliminated, the flow of the drilling fluid through the ball dropping tool 102 may urge the ball 112 from the side bore 132 and into the bypass passage 131 after the actuator arms 151, 152 are retracted. As another example, if the spring 154 is eliminated, an actuator may be included that is adapted to urge the ball 112 from the side bore 132. This additional actuator may have an actuator arm that is movable within the side bore 132 and positioned approximately perpendicular to the actuator arms 151, 152 shown.

In the example shown, a cap 158 is within the side bore 132. The cap 158 includes a cap end wall 160 and a cap side wall 162. The cap end wall 160 is coupled to portions 164 of the cap side wall 162. The cap side wall 162 may form a cylinder and, thus, a cross-section of the cap 158 may be circular. In another example, the cross-section of the cap 158 may be a polygon.

The cap side wall 162 defines a cap opening 165. The cap opening 165 faces and opens into the bypass passage 131. The coupling between the cap opening 165 and the bypass passage 131 allows the ball 112 to move into the bypass passage 131 from the side bore 132 when the actuators 146, 148 are in the retracted position. The cap end wall 160 may include a spring seat 166. The spring seat 166 is engaged by the spring 154.

In the example shown, the side bore 132 includes an internal step 167. The internal step 167 extends inwardly relative to a side bore sidewall 168 and forms a stop 169.

The cap side wall 162 includes an end portion 170. The end portion 170 of the cap side wall 162 engages the internal step 167. The cap 158 is shown being positioned between the internal step 167 and an opposing surface 172 of the inner body 126 that defines the side bore 132.

A ball guide 174 is within the cap 158. The ball guide 174 has an outer surface 176 that slidably engages the side bore sidewall 168. The spring 154 is positioned between the ball guide 174 and the opposing surface 172 of the inner body 126. The ball guide 174 includes a ball seat 178. The ball 112 is received within the ball seat 178.

The ball guide 174 is adapted to engage the stop 169. For example, when the actuators 146, 148 retract and the spring 154 urges the ball guide 174 and the ball 112 in the direction generally indicated by the arrow 156, the ball guide 174 is urged into engagement with the stop 169. The engagement between the ball guide 174 and the stop 169 retains the ball guide 174 and the springs 154 within the cap 158.

In the example shown, the ball seat 178 includes a ball seat through hole 180. The ball seat through hole 180 allows a portion of the ball 112 to be on one side of the ball guide 174 and another portion of the ball 112 to be another side of the ball guide. The ball seat 178 may include a tapered ball seat surface 182. The tapered ball seat surface 182 may have a contour that corresponds to a contour of the ball 112.

Still referring to FIG. 4, the inner body 126 has an external surface 184. The external surface 184 defines a side opening 186 (shown more clearly in FIGS. 2 and 3). The side opening 186 allows access to the side bore 132. Prior to the internal assembly 124 being installed within the outer body 116, the side opening 186 allows the cap 158 to be positioned within the side bore 132. The cap 158 may be made of a material that allows the cap 158 to plastically deform during the installation process. The material may include plastic. The cap 158 includes a chamfered end 189. The engagement between the chamfered end 189 and the inner body 126 when the cap 158 is being installed within the side bore 132 may encourage the plastic deformation of the cap 158 or otherwise ease the installation of the cap 158 within the inner body 126.

The cap 158 may be positioned within the side bore 132 with the spring 154 and/or the ball guide 174 positioned therein. In another example, the spring 154 and/or the ball guide 174 may be positioned within the cap 158 after the cap 158 is installed within the side bore 132.

In the example shown, the cap side wall 162 includes an external flange 188 and the side bore 132 includes a groove 190. The groove 190 is adapted to receive the external flange 188. When the cap 158 is installed within the side bore 132, a snap fit connection may be formed between the external flange 188 and the groove 190.

After the components 112, 154, 158, and/or 174 are installed within the inner body 126, the inner body 126 may be positioned within the ball dropping tool 102. The outer body 116 has an internal surface 192 that defines the axial bore 122. The internal surface 192 covers the side opening 186 of the inner body 126. The internal surface 192 may form part of the bypass passage 131.

While the example shown in FIG. 4 illustrates one of the balls 112, the actuators 146, 148, the springs 154, the cap 158, and the ball guide 174, each one of the side bores of the ball dropping tool 102 may have the same or similar structure. Thus, the ball dropping tool 102 may include a plurality of balls (e.g., 112, 114) each positioned within one of the side bores (e.g., 132, 133) and a plurality of actuators (e.g., 146, 148) positioned within the inner body 126. One or more of the actuators may be associated with each one of the balls.

From the foregoing, it will be appreciated that the above disclosed apparatus, methods and articles of manufacture enable balls to be dropped on-demand downhole. As a result, less time may be incurred between the ball being dropped and the ball-operated tool actuating. Moreover, the disclosed examples allow balls to reach ball-operated tools that are positioned downhole of obstructions/restrictions in the drill string that would otherwise prevent the ball from reaching these ball-operated tools.

In accordance with a first example, a drill string includes a ball dropping tool and a ball-operated tool. The ball dropping tool includes an outer body, an inner body, at least one side bore, a ball, and an actuator. The outer body has a first end, a second end, and an axial bore extending between the first end and the second end and forming a flow path. The inner body has a first end and a second end and forms a bypass passage extending between the first end and the second end of the inner body. A side bore is defined by the inner body and is at an angle relative to the axial bore of the outer body. The bypass passage is in a portion of the flow path and is in communication with the side bore. The ball is within the side bore. The actuator is within the outer body. The actuator is moveable between a retaining position wherein the ball is retained within the side bore and a release position wherein the ball is released from the side bore and into the bypass passage. The ball-operated tool is adapted to be positioned to receive the ball from the ball dropping tool and arranged to actuate in response to receiving the ball.

In accordance with a second example, a ball dropping tool includes an outer body, an inner body, a side bore, a ball, and an actuator. The outer body has a first end, a second end, and an axial bore extending between the first end and the second end and forming a flow path. The inner body has a first end and a second end and forms a bypass passage extending between the first end and the second end of the inner body. The side bore is defined by the inner body and is at an angle relative to the axial bore of the outer body. The bypass passage is in a portion of the flow path and is in communication with the side bore. The ball is within the side bore.

The actuator is within the outer body. The actuator is movable between a retaining position wherein the ball is retained within the side bore and a release position wherein the ball is released from the side bore and into the bypass passage.

In accordance with a third example, an internal assembly for use with a ball dropping tool includes a body, a bypass passage, a plurality of balls, and a plurality of actuators. The body includes a first end and a second end and defines a plurality of side bores. The bypass passage extends between the first end and the second end and is in communication with each of the side bores. A respective ball is within each of the side bores. The actuators are moveable between a retaining position retaining the ball within a corresponding one of the side bores and a release position that allows the ball to move from the corresponding side bore and into the bypass passage.

In accordance with a fourth example, a drill string includes a ball dropping tool and a ball-operated tool. The ball dropping tool includes an outer body including a first end and a second end and an axial bore extending between the first end and the second end. The internal assembly is positioned within the axial bore. The internal assembly includes an inner body, a bypass passage, a ball, and an actuator. The inner body includes a first end and a second end and defines a transverse bore. The bypass passage extends between the first end and the second end and is in communication with the transverse bore. The ball is within the transverse bore. The actuator is movable between a position retaining the position of the ball within the transverse bore and a release position that allows the ball to move from the transverse bore and into the bypass passage. The ball-operated tool is adapted to be positioned downhole of the ball dropping tool and to actuate in response to receiving the ball from the ball dropping tool.

In accordance with a fifth example, a ball dropping tool includes an outer body and an internal assembly. The outer body includes a first end and a second end and an axial bore extending between the first end and the second end. The internal assembly is positioned within the axial bore. The internal assembly includes an inner body, a bypass passage, a ball, and an actuator. The inner body includes a first end and a second end and defines a transverse bore. The bypass passage extends between the first end and the second end and is in communication with the transverse bore. The ball is within the transverse bore. The actuator is movable between a retaining position retaining the position of the ball within the transverse bore and a release position that allows the ball to move from the transverse bore and into the bypass passage.

In further accordance with the foregoing first, second, third, fourth, and/or fifth examples, an apparatus and/or method may further include any one or more of the following aspects.

In accordance with one aspect that may be combined with any one or more other aspects described herein, the inner body defines a second side bore. A second ball is within the second side bore and a second actuator is within the outer body. The second actuator is movable between a retaining position wherein the second ball is retained within the second side bore and a release position wherein the second ball is released from the second side bore and into the bypass passage.

In accordance with one aspect that may be combined with any one or more other aspects described herein, the second side bore is longitudinally spaced from the side bore.

In accordance with one aspect that may be combined with any one or more other aspects described herein, the second ball is a different size than the ball.

In accordance with one aspect that may be combined with any one or more other aspects described herein, a second ball-operated tool is adapted to be positioned downhole of the ball dropping tool and the ball-operated tool. The second ball-operated tool is adapted to actuate in response to receiving the ball or the second ball from the ball dropping tool.

In accordance with one aspect that may be combined with any one or more other aspects described herein, the inner body defines a side opening and the outer body partially defines the bypass passage.

In accordance with one aspect that may be combined with any one or more other aspects described herein, a second actuator is within the outer body and opposing the actuator. Each actuator has an actuator arm and is moveable between extending the actuator arm into the side bore and retaining the position of the ball within the side bore and retracting the actuator arm relative to the side bore to allow the ball to move from the side bore and into the bypass passage.

In accordance with one aspect that may be combined with any one or more other aspects described herein, the inner body defines a pair of opposing actuator bores that are in communication with the side bore. The actuators are within the actuator bores.

In accordance with one aspect that may be combined with any one or more other aspects described herein, the inner body has an external surface defining a side opening to allow access to the side bore.

In accordance with one aspect that may be combined with any one or more other aspects described herein, the outer body has an internal surface defining the axial bore and covering the side opening of the inner body.

In accordance with one aspect that may be combined with any one or more other aspects described herein, a spring or other biasing member is within the side bore and adapted to urge the ball out of the side bore.

In accordance with one aspect that may be combined with any one or more other aspects described herein, a cap is within the side bore. The cap has a cap end wall and a cap side wall. The cap end wall couples portions of the cap side wall. The cap side wall defines a cap opening that faces and opens into the bypass passage.

In accordance with one aspect that may be combined with any one or more other aspects described herein, the cap end wall includes a spring seat engaged by the spring.

In accordance with one aspect that may be combined with any one or more other aspects described herein, the side bore includes an internal step and an end portion of the cap side wall engages the internal step.

In accordance with one aspect that may be combined with any one or more other aspects described herein, the internal step extends inwardly from the cap side wall and forms a stop. A ball guide having a ball seat is within the cap. The ball guide is biased by the spring and receives the ball. The ball guide is adapted to engage the stop.

In accordance with one aspect that may be combined with any one or more other aspects described herein, the plurality of balls includes a first ball and a second ball. The first ball and the second ball are different in size.

In accordance with one aspect that may be combined with any one or more other aspects described herein, the body has an external surface defining a side opening to allow access to the side bores.

In accordance with one aspect that may be combined with any one or more other aspects described herein, there are a plurality of springs. At least one of the springs is within each side bore and positioned to bias the corresponding ball.

While several examples and aspects have been disclosed herein, any features from any examples and aspects may be combined with or replaced by other features from other examples. Moreover, while several examples have been disclosed herein, changes may be made to the disclosed examples within departing from the scope of the claims.

Further, in the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more". Further, herein the term "substantially" as used herein means a majority, or almost all, or all, or an amount with a range of about 51% to about 100%, for example. The term "about" as used herein is intended to include implementations that perform the same function in substantially the same way, and in physical dimensions include at least dimensions within standard manufacturing tolerances or within 1%, 2%, or 5% of the stated value. Examples herein are intended to be illustrative only and are presented for discussion purposes and not by way of limitation.

Some examples in the present disclosure are be directed to or include use of computer-readable storage medium storing computer-executable instructions and executable by one or more processors of a computing device via which computer-readable media is accessed. Computer-readable media may be any available media that may be accessed by a computer, and may include different types, including storage media or transmission media. By way of example, such computer-readable storage media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk and Blu-rayR™ disc where disks usually reproduce data magnetically, while discs reproduce data optically with lasers. Computer-readable transmission media, in contrast, relates to non-storage media that carry desired program code or data structures that may be accessed by a computer. For instance, a wireless link or carrier wave are examples of computer-readable transmission media. Computer-readable media also includes combinations of computer-readable storage media and computer-readable transmission media.

Note also that the software implemented aspects of the subject matter claimed below are usually encoded on some form of program on storage media or implemented over some type of transmission media. The storage medium is a non-transmission medium and may be magnetic (e.g., a floppy disk or a hard drive) or optical (e.g., a compact disk read only memory, or "CD ROM"), and may be read only or random access, or may have read-write access. Similarly, the transmission medium may be twisted wire pairs, coaxial cable, optical fibre, wireless links, carrier waves, or some other suitable transmission medium known to the art. The claimed subject matter is not limited by these aspects of any given implementation.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A drill string, comprising:

a ball dropping tool, the ball dropping tool including:

an outer body having a first end, a second end, and an axial bore extending between the first end and the second end of the outer body and forming a flow path;

an inner body having a first end and a second end and forming a bypass passage extending between the first end and the second end of the inner body;

a side bore defined by the inner body and angled relative to the axial bore of the outer body, wherein the bypass passage is in a portion of the flow path and in communication with the side bore;

a ball within the side bore; and an actuator within the outer body, the actuator being moveable between a retaining position wherein the ball is retained within the side bore and a release position wherein the ball is released from the side bore and into the bypass passage; and a ball-operated tool adapted to be positioned to receive the ball from the ball dropping tool and arranged to actuate in response to receiving the ball.

2. The drill string of claim 1, wherein the ball is a first ball and the inner body defines a second side bore, further comprising:

a second ball within the second side bore; and a second actuator within the outer body, wherein the second actuator is movable between a retaining position wherein the second ball is retained within the second side bore and a release position wherein the second ball is released from the second side bore and into the bypass passage.

3. The drill string of claim 2, wherein the second side bore is longitudinally spaced from the side bore.

4. The drill string of claim 2, wherein the second ball is a different size than the first ball.

5. The drill string of claim 4, further comprising a second ball-operated tool adapted to be positioned downhole of the ball dropping tool and the ball-operated tool, the second ball-operated tool being adapted to actuate in response to receiving the first ball or the second ball from the ball dropping tool.

6. The drill string of claim 1, wherein the inner body defines a side opening and the outer body partially defines the bypass passage.

7. The drill string of claim 1, further comprising a second actuator within the outer body and opposing the actuator, each actuator having an actuator arm and being moveable between extending the actuator arm into the side bore and retaining the position of the ball within the side bore and retracting the actuator arm relative to the side bore to allow the ball to move from the side bore and into the bypass passage.

8. The drill string of claim 7, wherein the inner body defines a pair of opposing actuator bores that are in communication with the side bore, the actuators being within the actuator bores.

9. The drill string of claim 1, wherein the inner body has an external surface defining a side opening to allow access to the side bore.

10. The drill string of claim 9, wherein the outer body has an internal surface defining the axial bore and covering the side opening of the inner body.

11. A ball dropping tool, comprising:

an outer body having a first end, a second end, and an axial bore forming a flow path extending between the first end and the second end of the outer body;

an inner body having a first end and a second end and forming a bypass passage extending between the first end and the second end of the inner body;

a side bore defined by the inner body and angled relative to the axial bore of the outer body, wherein the bypass passage is in a portion of the flow path and in communication with the side bore;

a ball within the side bore; and an actuator within the outer body, the actuator being movable between a retaining position wherein the ball is retained within the side bore and a release position wherein the ball is released from the side bore and into the bypass passage.

12. The ball dropping tool of claim 11, further comprising a biasing member within the side bore and adapted to urge the ball out of the side bore.

13. The ball dropping tool of claim 12, further comprising a cap within the side bore, the cap having a cap end wall and a cap side wall, the cap end wall coupling portions of the cap side wall, the cap side wall defining a cap opening that faces and opens into the bypass passage.

14. The ball dropping tool of claim 13, wherein the cap end wall includes a seat engaged by the biasing member.

15. The ball dropping tool of claim 13, wherein the side bore includes an internal step and an end portion of the cap side wall engages the internal step.

16. The ball dropping tool of claim 15, wherein the internal step extends inwardly from the cap side wall and forms a stop, the ball dropping tool further comprising:

a ball guide having a ball seat within the cap, the ball guide biased by a spring of the biasing device and receiving the ball, wherein the ball guide is adapted to engage the stop.

* * * * *